United States Patent [19]

Yokota

[11] 4,429,985

[45] Feb. 7, 1984

[54] RECORDING SYSTEM PROVIDED WITH A DEVICE FOR CORRECTING DEVIATION OF RECORDING MEMBER IN ENDLESS BELT FORM

[75] Inventor: Takashi Yokota, Tokyo, Japan

[73] Assignee: Ricoh Company, Ltd., Japan

[21] Appl. No.: 349,301

[22] Filed: Feb. 16, 1982

[30] Foreign Application Priority Data

Feb. 20, 1981 [JP] Japan ..... 56-22909
Feb. 23, 1981 [JP] Japan ..... 56-25269
Feb. 23, 1981 [JP] Japan ..... 56-25721

[51] Int. Cl.[3] ..... G03G 15/00

[52] U.S. Cl. ..... 355/3 BE; 355/16; 250/548; 474/106

[58] Field of Search ..... 355/3 BE, 16; 474/102-108; 250/548, 561, 571

[56] References Cited

U.S. PATENT DOCUMENTS 2,344,817 3/1944 Hlavaty ..... 474/106 X
2,914,957 12/1959 Johnson ..... 474/106 X
3,117,462 1/1964 Davis ..... 474/108 X
3,368,665 2/1968 Jinkins ..... 474/106 X
3,694,068 9/1972 Jordan ..... 474/106
3,726,588 4/1973 Moser ..... 355/16 X
4,170,175 10/1979 Conlon ..... 355/3 BE
4,344,693 8/1982 Hamaker ..... 355/3 BE

OTHER PUBLICATIONS

*Research Disclosure,* "Web Tracking Apparatus", pp. 29-31, May, 1976.

*Primary Examiner*—R. L. Moses
*Attorney, Agent, or Firm*—Guy W. Shoup; Gerard F. Dunne

[57] ABSTRACT

A recording system including a recording member of the endless belt form in which a series of information is recorded while the recording member is being moved, deviation sensing means operative to sense a deviation of the recording member, deviation correcting means operative to correct the deviation of the recording member, and a control circuit for actuating the deviation correcting means based on a signal generated by the deviation sensing means upon sensing the deviation.

A deviation of the recording member of the endless belt form can be corrected without causing deformation of the recording member, and the recording system can be fabricated simply at low cost.

12 Claims, 24 Drawing Figures

RECORDING SYSTEM PROVIDED WITH A DEVICE FOR CORRECTING DEVIATION OF RECORDING MEMBER IN ENDLESS BELT FORM

BACKGROUND OF THE INVENTION

This invention relates to a recording system for performing recording with a recording member in the form of an endless belt which is supported and driven by a plurality of rollers.

In the recording system of the aforesaid construction, the recording member of the endless belt form is driven by the rollers. During operation, the recording member might be shifted in a direction at right angles to the direction in which it is driven or it might be deflected from its normal direction of movement or move in a zigzag manner with respect to its normal direction of movement due to some errors occurring in the tension imparted to the endless belt recording member by the rollers or errors occurring in the parallelism of the roller axes which should essentially be genuinely parallel. When this phenomenon occurs, the image formed on the recording member or the image formed on the recording sheet by transfer printing might be distorted. Thus this phenomenon should be avoided.

To this end, the following devices are known in the prior art. In one device known in the art, the rollers for supporting and driving the recording member of the endless belt are each formed with a flange for preventing deflection of ends of the recording member to avoid zigzagging or displacements of the recording member. In another device, at least one of the rollers for supporting and driving the endless belt recording member is provided with automatic self-aligning means operative to vary the inclination of its automatic self-aligning shaft contained therein to cause the belt to shift in a direction opposite the direction in which the belt is displaced or deviates by utilizing the force produced by the deviation of the belt. In the former device, stress is produced at all times in the end portion of the recording member of the endless belt by the force produced by the deviation of the recording member. The stress thus produced causes deformation of the end portion of the recording member of the endless belt, thereby greatly reducing the service life of the belt and reliability of the recording system. Thus to use this recording system requires either an increase in the thickness of the base of the recording member to increase the resistance offered by the belt itself to the deformation of its end portion or a reduction in the force produced by the deviation of the belt. When the base of the recording member of the endless belt has its thickness increased, however, problems are raised with regard to a reduction in the strength with which the recording layer attached to the base is maintained in intimate contact therewith and an increase in the tension of the belt due to an increase in bending stress. Thus an increase in the thickness of the base of the belt is not desirable. When an attempt is made to reduce the force with which the belt deviates, it is necessary to effect fine adjustments of the belt tension, and this inevitably makes the recording system high in precision finish and complex in construction. Meanwhile, the automatic self-aligning means could not operate satisfactorily unless there is provided rollers of high precision finishes. This would make the system complex in construction, large in size and high in cost.

SUMMARY OF THE INVENTION

This invention has been developed for the purpose of obviating the aforesaid disadvantages of the prior art. Accordingly the invention has as its object the provision of a recording system provided with a device for correcting the deviation of a recording member of the endless belt form without causing the end portion of the endless belt recording member to undergo deformation, which device does not require complex construction of high precision.

The aforesaid object can be accomplished by an endless belt deviation correcting device for an endless belt recording member comprising deviation sensing means capable of sensing a deviation of the endless belt recording member and generating a signal when the recording member shifts in a direction at a right angles to the direction in which it is driven, deviation correcting means for correcting the deviation of the endless belt recording member, and a control circuit operative in response to a signal generated by the deviation sencing means to actuate the deviation correcting means.

By providing the deviation sensing means and the deviation correcting means separate from and independent of each other, it is possible to simplify the constructions of these two means. The use of such deviation correcting means of simple construction makes it possible to attain the end of correcting any deviation of the endless belt recording member without causing same to undergo deformation.

The invention enables deviation of an endless belt recording member to be corrected by a simple mechanism without causing any damage thereto. The recording system incorporating the endless belt recording member can have its construction simplified and its cost reduced by utilizing the present invention.

DESCRIPTION OF THE PREFERRED EMBODIMENTS

Figure 1:
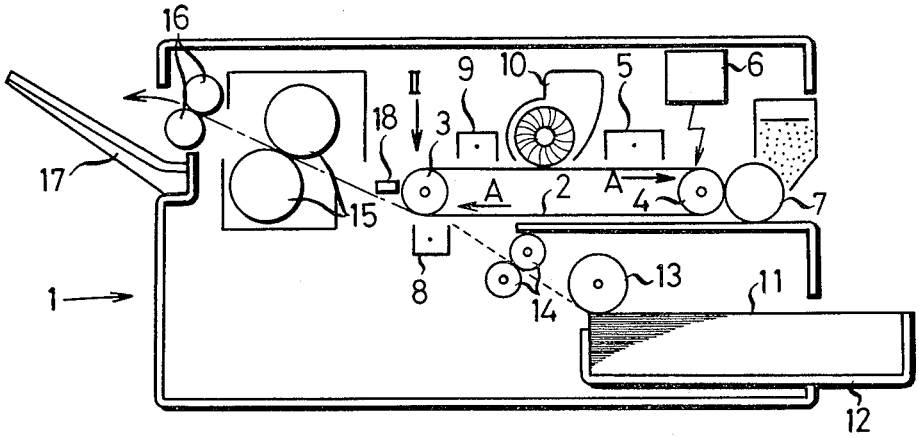
FIG. 1 is a sectional side view of a photoelectrostatic recording system provided with the deviation correcting device comprising one embodiment of the invention.

FIG. 1 is a sectional side view of recording system or a photoelectrostatic recording system, in particular, according to the invention. In the recording system 1, the recording member comprises a photosensitive member 2 of the endless belt form including a base film formed of polyethylene terephthalte, for example, and a photoconductive layer formed of organic or inorganic material on the base film. The photosensitive member 2 is supported on a plurality of (two as shown) drive rollers 3 and 4 driven to move in the direction of arrows A with one of the rollers serving as a drive roller. Installed around the photosensitive member 2 are a charger 5 for charging the photosensitive member 2, an exposing device 6 for exposing the charged photosensitive member to an optical image of a document to cause an electrostatic latent image to be formed on its surface, a developer 7 for developing the electrostatic latent image into a visible image, a transfer-printing device 8 for printing the visible image on a recording sheet by transfer-printing, a charge removing device 9 for removing charge from the surface of the photosensitive member 2 to use same for exposing purposes again, and a cleaning device 10 for cleaning the surface of the photosensitive member 2. Located beneath the recording system 1 is a sheet containing box 12 for recording sheets 11 to be placed therein. A sheet feeding device 13 is located above the sheet containing box 12 to feed each sheet to the transfer-printing station along a path indicated by a broken line. The numeral 14 designates auxiliary rollers. The recording sheet fed to the transfer-printing station and has printed thereon a visible image by transfer-printing and is passed along a dash-and-dot line path to a fixing device 15 where the printed image is fixed, before the recording sheet is ejected by discharge rollers 16 on to a printed sheet tray 17.

The photosensitive member 2 of the endless belt form is provided with the deviation correction device according to the invention comprising deviation sensing means and control means. The deviation correction device will be described in detail with respect to sensing means and control means.

The sensing means based on a first concept will be described. This sensing means is based on the concept of detecting deviation of the photosensitive member from interrupted light and comprises a light source, a light receiving element and a light intercepting member movable in and out of the path of light between the light source and the light receiving element.

Figure 2:
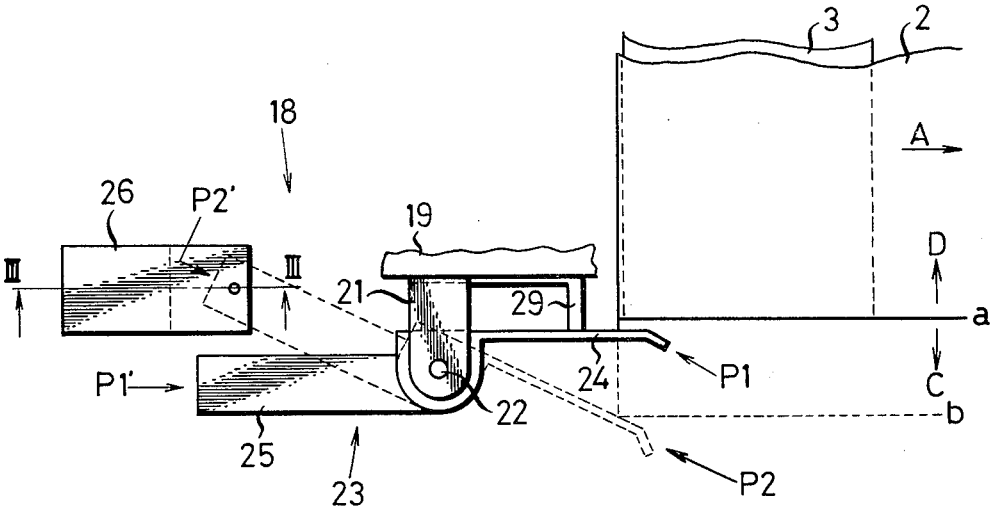
FIG. 2 is a plan view of the essential portions of a first form of deviation sensing means.

FIG. 2 shows a first form of deviation sensing means based on the concept of photo-interruption which is arranged in a position juxtaposed against a portion of the endless belt photosensitive member 2 wound on the roller 3 (hereinafter curved portion) as indicated at 18 in FIG. 1. FIG. 2 is a plan view as seen in the direction of an arrow II in FIG. 1.

In FIG. 2, the deviation sensing means 18 comprises a frame 19 located in front of the photosensitive member 2 and having attached thereto a support member 21 supporting a feeler 23 for pivotal movement about a pivot 22. The feeler 23 is composed of a contact member 24 disposed rightwardly of the support member 21 on the side of the photosensitive member 2 and a light intercepting member 25 disposed leftwardly of the support member 21 in FIG. 2, with the contact member 24 being brought at its forward end into contact with an end portion 2*a* of the photosensitive member 2. A photo-interrupter 26 comprising the light source and the light receiving member is located in a zone within the pivotal movement of the light intercepting member 25.

Figure 3:
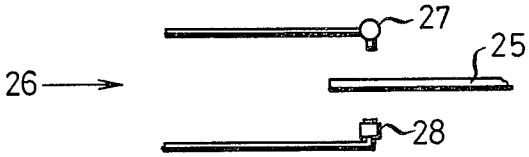
FIG. 3 is a sectional side view of the photo-interrupter taken along the line III—III in FIG. 2.

FIG. 3 is a sectional view taken along the line III—III in FIG. 2, showing the photo-interrupter 26. The photo-interrupter 26 includes the light source 27 and the light receiving element 28 and generates an output signal corresponding to the quantity of light emitted by the light source 27 and received by the light receiving element 28. The light intercepting member 25 intercepts the light transmitted through the path from the light source 27 to the light receiving element 28 during its pivotal movement.

Referring to FIG. 2 again, an L-shaped stopper 29 is attached to the frame 19 for restricting the movement of the contact member 24 in a counterclockwise direction. The feeler 23 has mounted thereon a tensioning member, not shown, such as a coil spring, a plate spring, etc. which biases the feeler in the counterclockwise direction. Thus when the contact member 24 is kept from contacting the end portion 2*a* of the photosensitive member 2, the contact member 24 is forced against the stopper 29 by the action of the tensioning member.

Operation of the deviation sensing means 18 of the aforesaid construction will be described. In a normal printing mode, the photosensitive member 2 moves in the direction of an arrow A in its solid line position a. When the photosensitive member 2 is in this position, the contact member 24 is kept from contacting the end portion 2*a* of the photosensitive member 2 and the light intercepting member 25 is prevented from intercepting light emitted by the light source 27 and received by the light receiving member 28. Thus the photo-interrupter 26 generates an output signal commensurate with the quantity of light passing through the path of light between the light source 27 and the light receiving element 28. In the event that the photosensitive member 2 deviates in the direction of an arrow C and reaches a position b indicated by a broken line, the contact member 24 is first brought into contact with the end portion 2*a* of the photosensitive member 2 in a position P1 shown in a solid line and then moves in pivotal movement about the pivot 22 in a clockwise direction until it eaches a position P2 indicated by broken lines. Simultaneously as the contact member 24 moves in pivotal movement, the light intercepting member 25 moves in pivotal movement from a solid line position P1' to a broken line position P2', to thereby interrupt light emitted by the light source 27 and transmitted to the light receiving element 28 of the photo-interrupter 26. This causes a change to occur in the output signal of the photo-interrupter 26. Stated differently, deviation of the photosensitive member 2 in the C direction is sensed by detecting a change in the output signal of the photo-interrupter 26.

The aforesaid description refers to a deviation of the photosensitive member 2 in the C direction. The photosensitive member 2 has mounted at the other end portion another deviation sensing means 18, not shown, of the same construction as the deviation sensing means 18 described hereinabove to sense a deviation of the photosensitive member 2 in a direction opposite the C direction or a direction indicated by an arrow D in FIG. 2.

Variations in the output signals of the two deviation sensing means 18 described hereinabove are transmitted through a control circuit subsequently to be described to deviation correcting means subsequently to be described, to thereby suitably correct any deviation of the photosensitive member 2 of the belt form.

Figure 4:
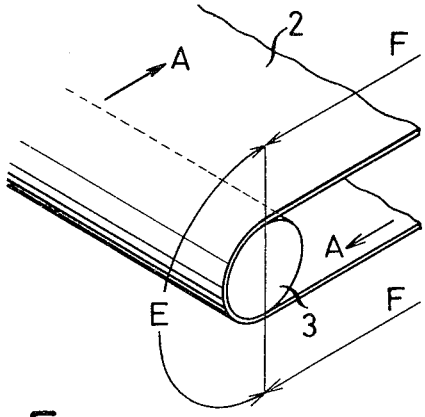
FIG. 4 is a perspective view of the endless belt photosensitive member trained over the roller.

As aforesaid, the deviation sensing means is located in a position juxtaposed against the curved portion of the endless belt photosensitive member 2. The reason for this location will be described by referring to the drawings. FIG. 4 shows the endless belt photosensitive member 2 and the roller 3 supporting same, wherein a zone indicated by a letter E includes the curved portion of the belt referred to hereinabove. The endless belt photosensitive member 2 has another curved portion in a corresponding zone for the other roller 4 (FIG. 1), so that the photosensitive member 2 in a zone connecting the two curved portions at the opposite ends or a zone F is straight. This zone F will be hereinafter referred to as a straight zone of the endless belt photosensitive member 2. When a force is exerted on the photosensitive member 2 at one of the end portions thereof in a direction which crosses at right angles the direction A in which the photosensitive member 2 is driven to move, the photosensitive member 2 is readily deformed in the straight zone F but difficultly to deform in the curved zone E. Thus the contact member 24 is advantageously brought into contact with the photosensitive member in the curved zone E in which the member 2 is difficultly deformed as compared with the straight zone F. This is conductive to stabilized pivotal movement of the contact member 24 and minimized influences exerted on the end portions of the photosensitive member 2.

Figure 5:
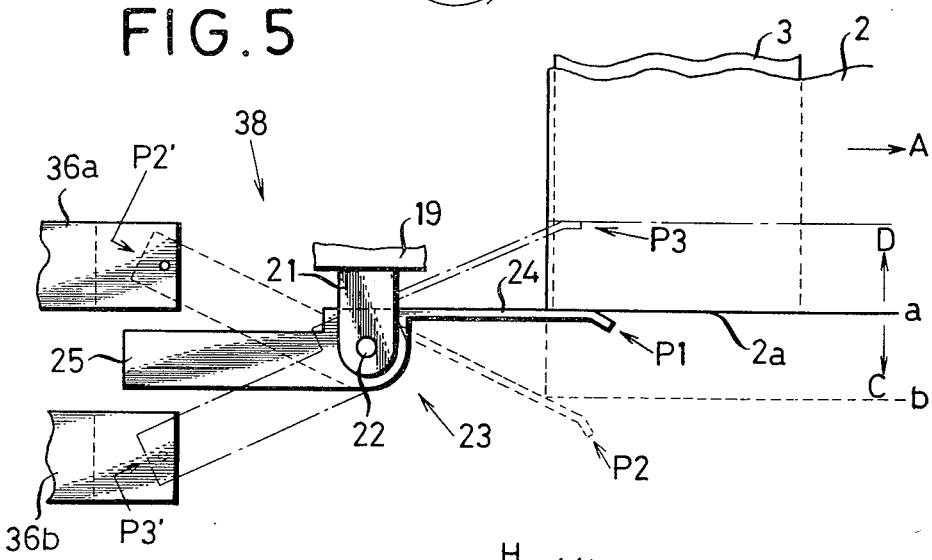
FIG. 5 is a plan view of the essential portions of a second form of deviation sensing means.

FIG. 5 shows a second form of deviation sensing means based on the first concept. This form of deviation sensing means is distinct from the deviation means shown in FIG. 2 in the following respects. The deviation sensing means 38 includes two photo-interrupters **36*a* and 36*b* located in suitable spaced-apart relation in the zone of pivotal movement of the light intercepting member 25, and the stopper 29 shown in FIG. 2 is dispensed with. Thus the contact member 24 is maintained in contact with the one end portion 2*a* of the photosensitive member 2 at all times by the biasing force of a tensioning member, not shown, and pivotally moves by following the movement of the one end portion 2*a*. Assume that the end portion 2*a* of the photosensitive member 2 moves from the solid line position a to the broken line position b. Then the contact member 24 also moves from the solid line position P1 to the broken line position P2. When the photosensitive member 2 moves to a dash-and-dot line position c, the contact member moves to a dash-and-dot line position P3. As soon as the contact member 24 moves to the position P2 or P3, the light intercepting member 25 moves to a position P2' or P3'. In this case, the photo-interrupters 36*a* and 36*b* are located such that when the light intercepting member 25 reaches the position P2' the photo-interrupter 36*a* has its light path blocked and when the light intercepting member 25 reaches the position P3' the photo-interrupter 36*b*** has its light path blocked.

The second form of deviation sensing means 38 is similar in other constructional details to the corresponding means of the first form, and like reference characters designate similar parts.

In the second form of deviation sensing means 38, the photosensitive member 2 moves in the A direction in the a position in a normal recording node. When the photosensitive member 2 is in this condition, the light intercepting member 25 does not block the light paths of the photo-interrupters **36*a* or 36*b*, so that the photo-interrupters 36*a* and 36*b* generate output signals commensurate with the quantity of light transmitted through their light paths. In the event that a deviation of the photosensitive member 2 in the C direction occurs and the photosensitive member 2 moves to the b position, the contact member 24 moves to the P2 position and the light intercepting member 25 simultaneously moves to the P2' position. Thus the light intercepting member 25 blocks the light path of the photo-interrupter 36*a*, so that the output signal of the photo-interrupter 36*a* shows a variation. Meanwhile when the photosensitive member 2 deviates in the D direction and moves to the c position, the contact member 24 moves to the P3 position and the light intercepting member 25 simultaneously moves to the P3' position. Thus the light intercepting member 25 blocks the light path of the photo-interrupter 36*b***, to thereby cause a change in the output signal thereof to occur.

Stated differently, a deviation of the photosensitive member 2 in the C direction is sensed from a change in the output signal of the photo-interrupter **36*a*, and a deviation thereof in the D direction is sensed from a chage in the output signal of the photo-interrupter 36*b***.

From the foregoing description, it will be appreciated that when the second form of deviation sensing means 38 is used, it is possible to sense deviation of the photosensitive member 2 in the C and D directions by using a single deviation sensing means 38.

The changes in the output signals of the photo-interrupters **36*a* and 36*b*** are transmitted to the belt deviation correcting means subsequently to be described in the same manner as described hereinabove by referring to the first form of deviation sensing means.

Figure 6:
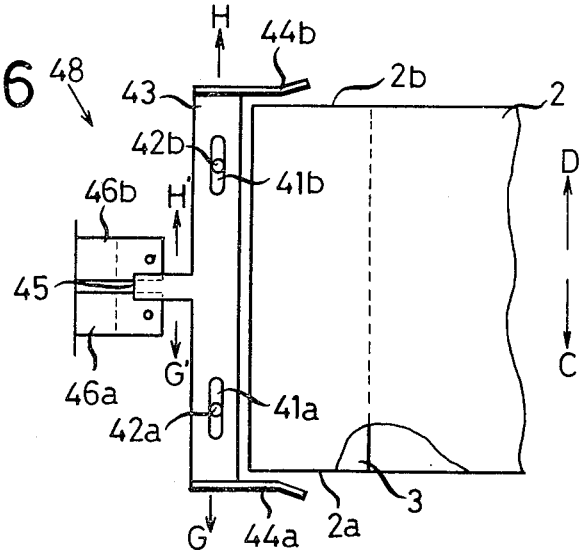
FIG. 6 is a plan view of a third form of deviation sensing means.

FIG. 6 shows a third form of deviation sensing means based on the first concept. The deviation sensing means 48 shown in the figure comprises a slide bar 43 located in front of (leftwardly in the figure) the curved zone on the roller side 3, the slide bar 3 extending axially of the roller 3 and having a length slightly greater than the width of the photosensitive member 2. The slide bar 43 is formed at its central portion with a forwardly (leftwardly in the figure) extending light intercepting member 45 and at opposite ends with contact members **44*a*** and 44*b* extending rearwardly (rightwardly in the figure). The slide bar 43 is also formed with slots 41*a* and 41*b* each having a major dimension extending axially of the roller 3 and having a pin 42*a* (42*b*) fitted therein. By virtue of the slots 41*a* and 41*b* and the pins 42*a* and 42*b*, the slide bar 43 is able to move parallel to the roller 3 for a distance corresponding to the length of the slots 41*a* and 41*b*. In the figure, arrows G and H indicate the directions in which the slide bar 43 moves. The contact members 44*a* and 44*b* each have a length such that when the photosensitive member 2 moves in the C direction or D direction, the member 44*a* is brought into contact with the end portion 2*a* or the member 44*b* with the end portion 2*b* of the member 2. When the slide bar 43 moves in the G direction or H direction, the light intercepting member 45 simultaneously moves is a G′ direction or an H′ direction. Two photo-interrupters 46*a* and 46*b* are located in a zone of movement of the light intercepting member 45 in such a manner that they are spaced apart a suitable distance from each other and arranged side by side to each other with respect to the direction of movement of the light intercepting member 45.

Operation of the deviation sensing means 48 of the aforesaid construction is as follows. When a deviation of the photosensitive member 2 in the C direction occurs, the end portion 2*a* is brought into contact with the contact member 44*a* and then presses thereagainst, to thereby move the slide bar 43 in the G direction. At this time, the light intercepting member 45 moves in the direction of an arrow G′ simultaneously as the slide bar 43 moves in the G direction. Upon the light intercepting member 45 reaching a position in which it blocks the light path of the photo-interrupter 46*a*, a change is caused to occur in the output signal of the photo-interrupter 46*a*. Stated differently, a deviation of the photosensitive member 2 in the C direction is sensed from a change in the output signal of the photo-interrupter 46*a*.

Meanwhile a deviation of the photosensitive member 2 in the D direction is sensed from a change in the output signal of the photo-interrupter 46*b*.

Figure 7:
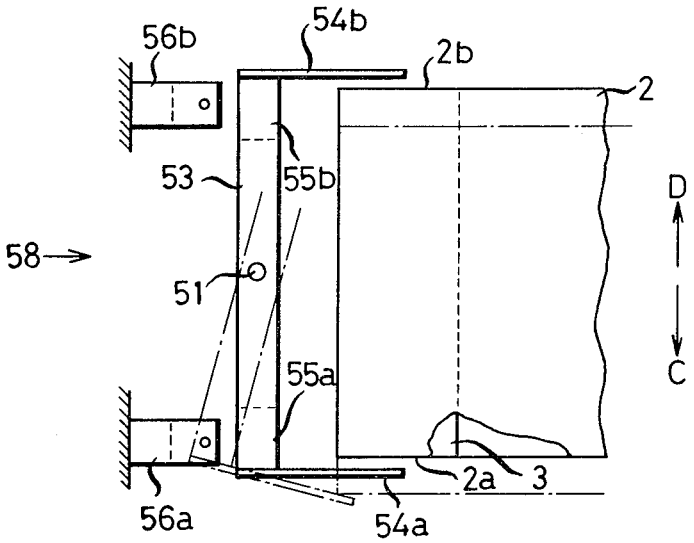
FIG. 7 is a plan view of a fourth form of deviation sensing means.

FIG. 7 shows a fourth form of deviation sensing means based on the first concept. The deviation sensing means 58 comprises a pivotal arm 53 located in front of (leftwardly in FIG. 7) of the curved zone of the photosensitive member 2 on the roller side, the pivotal arm 53 extending axially of the roller 3 and having a length slightly greater than the width of the photosensitive member 2. The pivotal member 53 which is pivotally supported at a pivot 51 in the central portion has contact members 54*a* and 54*b* connected to opposite ends thereof in such a manner that they extend rearwardly (rightwardly in FIG. 7). The contact members 54*a* and 54*b* each have a length such that when the photosensitive member 2 moves in the C direction or D direction, the member 54*a* is brought into contact with the end portion 2*a* or the member 54*b* with the end portion 2*b* of the member 2. Photo-interrupters 56*a* and 56*b* of the same construction as the photo-interrupter 26 shown in FIG. 3 are located in front of the opposite end portions (leftwardly in FIG. 7) of the pivotal arm 53 respectively. The opposite ends of the pivotal member 53 constitute light intercepting members 55*a* and 55*b* each having a thickness smaller than the length of the light paths of the photo-interrupters 56*a* and 56*b*. Thus as the pivotal arm 53 suitably moves in pivotal movement, the light intercepting member 55*a* or 55*b* is capable of blocking the light paths in the same manner as described by referring to FIG. 3.

Operation of the deviation sensing means 58 of the aforesaid construction is as follows. When a deviation in the C direction of the photosensitive member 2 occurs, the end portion 2*a* of the member 2 is brought into contact with the contact member 54*a* and presses same, to cause the pivotal arm 53 to move in pivotal movement in a clockwise direction to a dash-and-dot line position. The rotary arm 53 in the dash-and-dot line position blocks the light path of the photo-interrupter 56*a* by the light intercepting member 55*a* at one end thereof. When its light path is blocked, the photo-interrupter 56*a* has its output signal varied. That is, the deviation of the photosensitive member 2 in the C direction is sensed from the change in the output signal of the photo-interrupter 56*a*.

Meanwhile a deviation of the photosensitive member 2 in the D direction is sensed from a change in the output signal of the photo-interrupter 56*b* in the same manner as described by referring to the photo-interrupter 56*a*.

In all the forms of deviation sensing means based on the first concept, the photo-interrupters are used as sensing elements in combination with the light intercepting member or members. It is to be understood that the invention is not limited to this specific combination, and any other suitable combination, such microswitches and contact members or reed switches and magnets, of known sensing elements may be used.

Let us now turn to a second concept on which the sensing of a deviation of the photosensitive member of the belt 2. The second concept contemplates the use of photosensors of the reflection type each located in the vicinity of one of the opposite side portions of the photosensitive member in juxtaposed relation therewith, and patterns each capable of moving into a sensing zone of the respective photosensor when the respective side portion of the photosensitive member moves in a direction at right angles to the direction in which the photosensitive member is driven to move, the sensed patterns having a light reflection factor differing from that of the photosensitive member.

Figure 8:
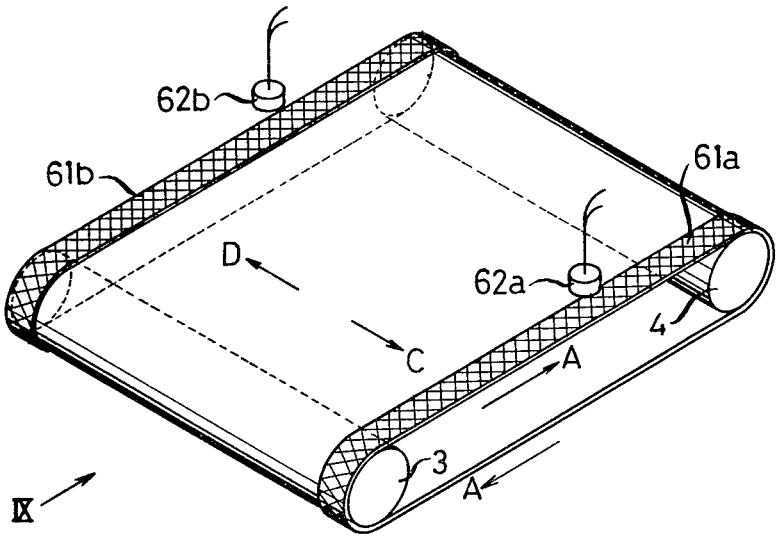
FIG. 8 is a perspective view of a fifth form of deviation sensing means.

FIG. 8 shows a first form of deviation sensing means based on the second concept. As shown, the photosensitive member 2 of the endless belt form supported by rollers 3 and 4 at opposite ends thereof is driven to move in the A direction and includes sensed patterns 61*a* and 61*b* mounted on opposite side peripheral areas respectively thereof. The sensed patterns 61*a* and 61*b* each having a suitable width is formed of material having a light reflection factor distinct from that of the photosensitive member 2. Reflection type light sensors 62*a* and 62*b* are arranged in positions above the opposite side peripheral areas respectively of the photosensitive member 2 in the straight zone thereof, i.e. in areas except the zones thereof in which the photosensitive member 2 is trained over the rollers 3 and 4.

Figure 9:
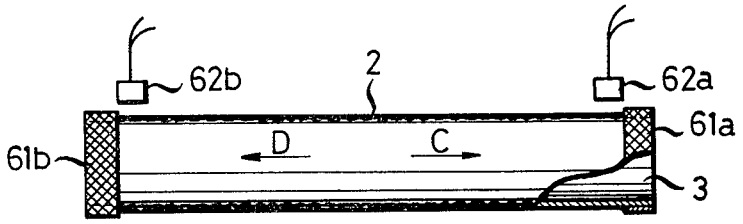
FIG. 9 is a front view of the embodiment of FIG. 8 as seen in the direction of an arrow IX in FIG. 8.

FIG. 9 is a front view as seen in the direction of an arrow IX in FIG. 8 which shows the positional relation of the reflection type light sensors 62*a* and 62*b*. The photosensitive member 2 shown in FIG. 9 is normally driven and no deviation occurs in the C direction or D direction which is at right angles to the direction in which the photosensitive member 2 is driven. When the member 2 is in this condition, the reflection type light sensors 62*a* and 62*b* are located above the photosensitive member 2 inwardly of the side peripheral areas thereof in which the sensed patterns 61*a* and 61*b* are located, so that the photosensitive member 2 is located in the sensing zones of the sensors 62*a* and 62*b* which each generate an output signal commensurate with the light reflection factor of the photosensitive member 2. In the interest of brevity, the devices located around the photosensitive members are omitted.

In the aforesaid construction, the photosensitive member 2 of the endless belt form travels in the direction of the arrow A in FIG. 8. If the photosensitive member 2 deviates in the C direction during its movement, then the sensed pattern 61*b* also shifts in the C direction. After moving a predetermined distance, the sensed pattern 61*b* enters the sensing zone of the light reflection type sensor 62*b*, causing a change to occur in the output signal of the latter. This is because the sensed pattern 61*b* has a light reflection factor distinct from that of the photosensitive member 2. Thus a deviation of the photosensitive member 2 in the C direction is sensed from a change in the output signal of the reflection type light sensor 62*b*.

Meanwhile when a deviation of the photosensitive member 2 occurs in the D direction, the phenomenon is sensed from a change in the output signal of the reflection type light sensor 62*a*, in the same fashion as described hereinabove by referring to the deviation in the C direction.

Figure 10:
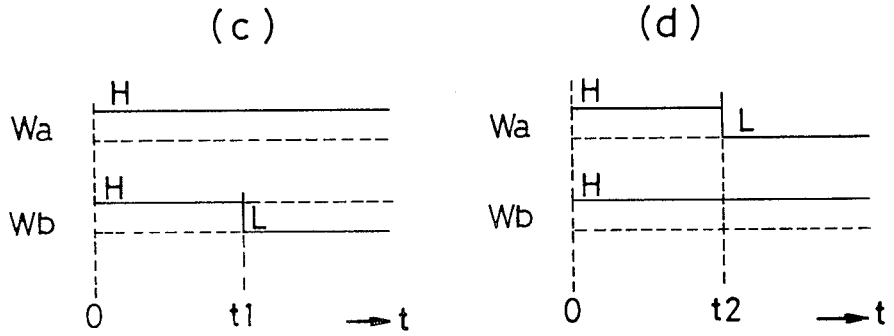
FIG. 10 is a time chart showing the condition of operation of the fifth form of deviation sensing means.

FIG. 10 is a time chart showing changes in the output signals of the reflection type light sensors 62*a* and 62*b* caused by deviations of the endless belt photosensitive member 2. C designates a deviation in the C direction, and D in the D direction. The photosensitive member 2 is located in the sensing zones of the sensors 62*a* and 62*b* from the time (t=0) the photosensitive member 2 begins to deviate in the C direction to the time (t=t1) the sensed pattern 61*b* reaches the sensing zone of the sensor 62*b*, so that the output signals Wa and Wb of the sensors 62*a* and 62*b* are both at an H level. After the time t1, the photosensitive member 2 exists in the sensing zone of the sensor 62*a* and the sensed pattern 61*b* in the sensing zone of the sensor 62*b*, therefore, Wa is an H level and Wb is an L level. The H and L levels may vary depending on the light reflection factors of the photosensitive member 2 and the sensed pattern 61*b*. For example, when the light reflection factor of the photosensitive member 2 is higher than that of the sensed pattern 61*b*, the H level is higher and the L level is lower.

When the photosensitive members deviates in the D direction, the two output signals Wa and Wb are both at an H level from the time (t=0) the photosensitive member 2 begins to deviate in the D direction to the time (t=t2) the sensed pattern 61*a* reaches the sensing zone of the sensor 62*a*, as is the case with the deviation in the C direction. However, after the time (t=t2), the sensed pattern 61*a* exists in the sensing zone of the sensor 62*a* and the photosensitive member 2 in the sensing zone of the sensor 62*b*, so that Wa is at the L level and Wb is at the H level.

Figure 11:
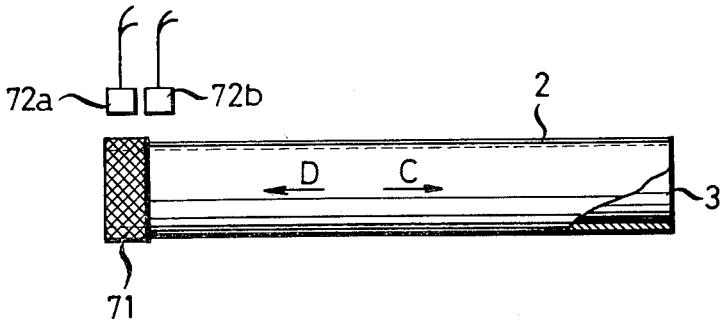
FIG. 11 is a front view of a sixth form of deviation sensing means.

FIG. 11 shows a second form of deviation sensing means based on the second concept. The photosensitive member 2 is formed with a sensed pattern 71 only in one side peripheral area thereof, which is formed of material distinct in light reflection factor from the material forming the photosensitive member 2, as is in the first form of deviation sensing means based on the second concept. As shown, the photosensitive member 2 is normally driven and no deviation occurs in the direction C or D at right angles to the direction in which the photosensitive member 2 is driven to move. A reflection type light sensor 72*a* is located above the sensed pattern 71 and another reflection type sensor 72*b* is located adjacent the sensor 72*a* in a position inwardly thereof with respect to the direction of movement of the member, or above the photosensitive member 2. Thus when the photosensitive member 2 is normally operating, the sensor 72*a* has the sensed pattern 71 in its sensing zone and the sensor 72*b* has the photosensitive member 2 in its sensing zone, so that the sensors 72*a* and 72*b* produce output signals commensurate with the light reflection factors of the sensed pattern 71 and the photosensitive member 2 respectively.

In the aforesaid construction, when the photosensitive member 2 shows a deviation in the C direction as it is driven to move, the sensed pattern 71 also moves in the C direction. After moving a predetermined distance, the sensed pattern 71 moves into the sensing zone of the sensor 72*b*, so that the output signal of the latter begins to show a change. Since the photosensitive member 2 continues to be in the sensing zone of the sensor 72*a*, no change occurs in the output signal of the latter. Thus the deviation of the photosensitive member 2 in the C direction is sensed from the change in the output signal of the sensor 72*b*.

Meanwhile when a deviation of the photosensitive member 2 occurs in the D direction, the sensed pattern 71 also shifts in the D direction. After the sensed pattern 71 has moved a predetermined distance, the photosensitive member 2 reaches the sensing zone of the sensor 72*a*, so that the output signal of the latter begins to show a change. Since the photosensitive member 2 continues to be in the sensing zone of the sensor 72*b*, no change occurs in the output signal of the latter. Thus the deviation of the photosensitive member 2 in the D direction is sensed from the change in the output signal of the sensor 72*a*.

Figure 12:
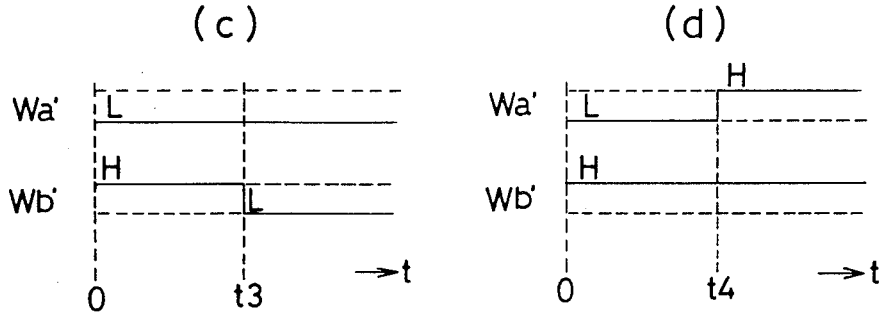
FIG. 12 is a time chart showing the condition of operation of the sixth form of deviation sensing means.

FIG. 12 is a time chart showing changes in the output signals of the reflection type light sensors 72*a* and 72*b* of the second form of deviation sensor caused by deflections of the photosensitive member 2. C indicates a deviation of the member 2 in the C direction and D a deviation thereof in the D direction. When the photosensitive member 2 deviates in the C direction, from the time (t=0) the member 2 begins to deviate in the C direction to the time (t=t3) the sensed pattern 71 reaches the sensing zone of the sensor 72*b*, the sensed pattern 71 exists in the sensing zone of the sensor 72*a* and the photosensitive member 2 in the sensing zone of the sensor 72*b*. Thus the output signal Wa' of the sensor 72*a* is at the L level and the output signal Wb' of the sensor 72*b* at the H level. After the time t3, the sensed pattern 71 exists in the sensing zones of the sensors 72*a* and 72*b*, so that the output signals Wa' and Wb' are both at the L level. The H and L levels are as described hereinabove with reference to the first form of deviation sensing means.

When the photosensitive member 2 shows a deviation in the D direction, the sensed pattern 71 and the photosensitive member 2 exist in the sensing zones of the sensors 72*a* and the 72*b* respectively from the time (t=0) the photosensitive member 2 begins to deviate to the time (t=t4) the photosensitive member 2 reaches the sensing zone of the sensor 72*a*, so that Wa' and Wb' are at the L and H levels respectively. After the time t4, Wa' and Wb' are both at the H level because the photosensitive member 2 exists in the sensing zones of the sensors 72*a* and 72*b*.

Figure 13:
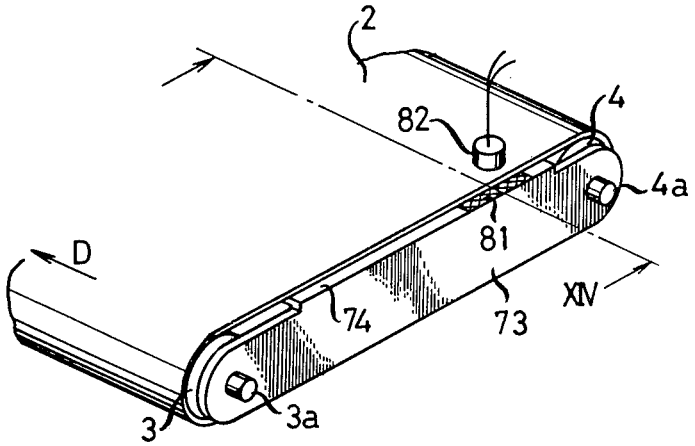
FIG. 13 is a perspective view, with certain parts being broken away, of a seventh form of deviation sensing means.
Figure 14:
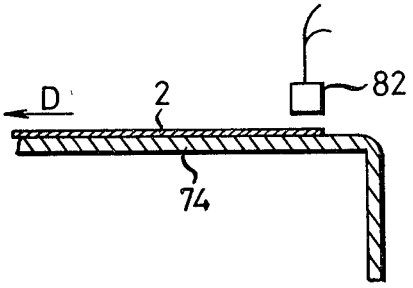
FIG. 14 is a sectional view of the deviation sensing means of FIG. 13 taken along the line XIV—XIV in FIG. 13.

FIG. 13 shows a third form of deviation sensing means based on the second concept. As shown, the photosensitive member 2 of the endless belt form is supported for travel by rollers 3 and 4 supported on shafts 3*a* and 4*a* respectively which support a belt guide plate 73 having a surface 74 for guiding the photosensitive member 2. The surface 74 of the guide plate 73 is formed in one portion thereof with a sensed pattern 81 of a suitable length disposed in a position close to roller 4. The sensed pattern 81 has a light reflection factor distinct from that of the photosensitive member 2. A reflection type light sensor 82 is disposed above one side peripheral area of the member 2 in a position adjacent the sensed pattern 81 in alignment therewith widthwise of the member 2, as shown in FIG. 4.

When the photosensitive member 2 deviates in the D direction, the sensed pattern 81 on the surface 74 of the guide plate 73 is gradually exposed. As the exposed sensed pattern 81 reaches the sensing zone of the sensor 82, the output signal of the sensor 82 shows a change to enable the deviation of the photosensitive member 2 in the D direction is sensed from the change in the output signal of the sensor 82.

In the foregoing description, the sensed pattern 81 has been described as being formed only in one portion of the surface 74 of the guide plate 73. However the invention is not limited to this specific form of the sensed pattern and the entire surface 74 of the guide plate 73 may be used as a sensed pattern so long as the surface 74 has a light reflection factor distinct from that of the photosensitive member 2.

The foregoing description deals with the belt deviation sensing means according to the invention. Deviation correcting means operative to correct any deviation of the photosensitive member of the endless belt form upon receipt of a signal from the sensing means will now be described.

Belt deviation correcting means based on a first concept will be described. According to the first concept, a difference is caused to occur in the tension given to the photosensitive endless belt between opposite ends of the roller axially thereof, to thereby correct any deviation of the belt.

Figure 15:
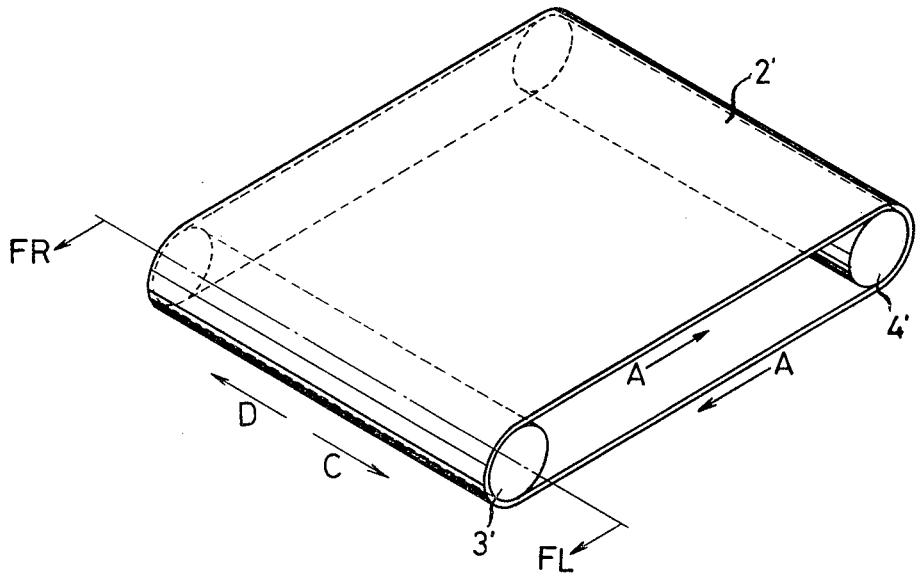
FIG. 15 is a perspective view of the endless belt recording member in explanation of a first principle of operation of the deviation correcting means.

FIG. 15 is a view in explanation of the principle of operation of the deviation correcting means based on the first concept. As shown, a belt 2′ is supported by two rollers 3′ and 4′ for movement. Of the two rollers, one roller 4′ has its rotary shafts fixed while the other roller 3′ has its rotary shafts mounted for movement in a direction in which the belt 2′ is tensioned, i.e. away from the roller 4′. FIG. 15 shows the belt and rollers in a condition in which the roller 3′ is allowed to move a suitable distance in the aforesaid direction, to thereby cause right side tension FR and left side tension FL to be produced in the belt 2′.

As the belt 2′ is driven to move in the A direction, a deviation is produced in the belt 2′, when the left side tension and the right side tension show a difference in value, in a direction toward the side at which the tension is smaller. More specifically, when the difference in tension FR>FL occurs, the belt 2′ deviates in the C direction; when the difference in tension is FR<FL, the belt 2′ deviates in the D direction. This phenomenon is marked when the belt 2′ is formed of material of low resilience, such as polyester terephthalate.

Some forms of deviation correcting means based on the aforesaid principle will be described. In the description to be presently made, parts similar to those shown in FIG. 1 are designated by like reference characters.

Figure 16:
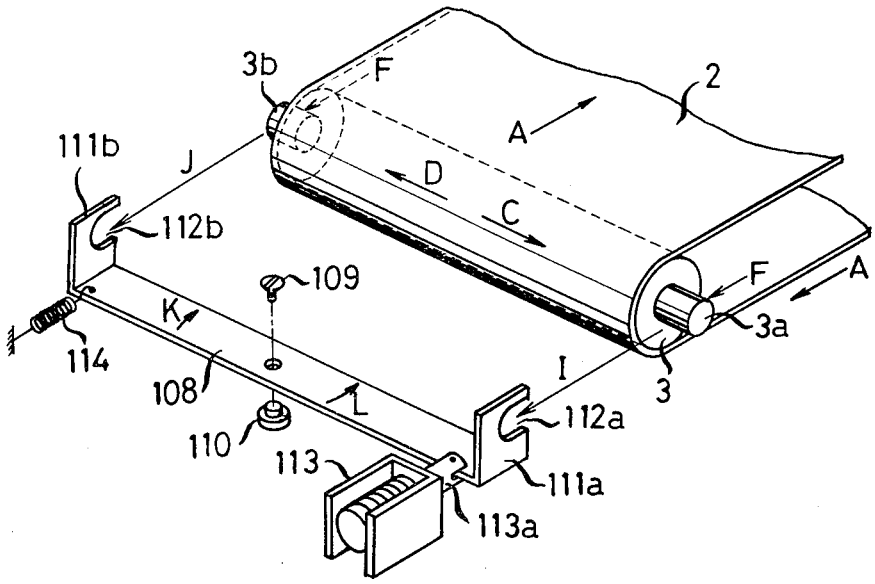
FIG. 16 is a perspective view of a first form of deviation correcting means.

FIG. 16 shows a first form of deviation correcting means based on a first concept, in which the photosensitive member 2 of the endless belt is supported by two rollers, or the roller 3 and the other roller which is shown as the roller 4 in FIG. 4. The roller 4 has its rotary shafts fixed while the roller 3 is supported by tension imparting means presently to be described.

Figure 17:
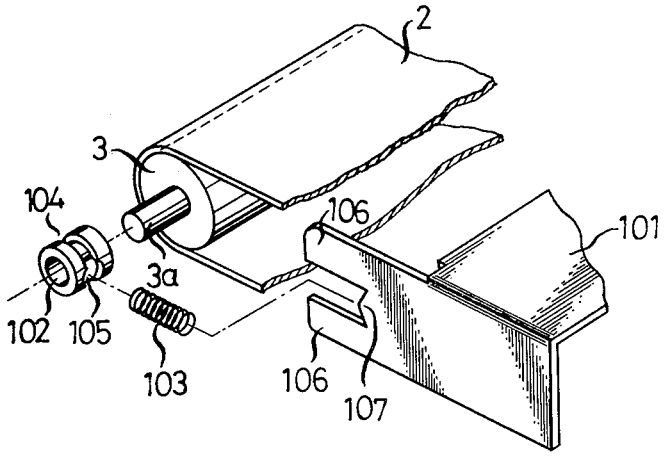
FIG. 17 is a perspective view, with certain parts being broken away, of the tension imparting means for producing roller tension F as shown in FIG. 16.

FIG. 17 shows one form of tension imparting means comprising a roller support member 101 affixed to a frame of the recording system for supporting the roller 3, bearings 102 (only one is shown) fitted over a shaft 3*a* of the roller 3, and compression springs 103 (only one is shown) mounted between one of the bearings 102 and the roller support member 101 for imparting tension to the roller 3. Each bearing 102 is formed on its outer periphery with a groove 104 and a support surface 105 for supporting one end of the compression spring 103. The roller support member 101 is formed with a lock 106 adapted to be fitted in the groove 104 on the bearing 102 and a spring stop 107 of triangular shape disposed at the end of the lock 106. The roller 3 supported in the shaft 3*a* journalled by the bearings 102 is fitted to the support member 101 in such a manner that the compression spring 103 is interposed between the support surface 105 and the spring stop 107.

Referring to FIG. 16 again, tension F is imparted to the photosensitive member 2 of the endless belt by the springs 103 through the roller 3. Located below the roller 3 is a control arm 108 pivoted at its central portion through a screw 109 at a pivot 110 so as to pivotally move in a direction parallel to the direction in which the tension F is imparted. The control arm 108 is formed at opposite ends thereof with control ends 111*a* and 111*b* extending substantially vertically and formed with cutouts 112*a* and 112*b* respectively. The cutouts 112*a* and 112*b* are each formed with an open end slightly larger in diameter than the diameter of the shafts 3*a* and 3*b* of the roller 3. In assembling, the shafts 3*a* and 3*b* are fitted in the open ends of the cutouts 112*a* and 112*b* in directions shown by arrows I and J respectively to accomplish connection of the control arm 108 to the roller 3. Thus after being connected to the control arm 108, the roller 3 is kept from moving vertically in FIG. 16 by the control ends 111*a* and 111*b*. A solenoid 113 has its rod 113*a* pivotally connected to a portion of the control arm 108 close to the control end 111*a*. Thus upon energization of the solenoid 113, the rod 113*a* is moved toward the body of the solenoid 113 to thereby pivotally move the control arm 108 about the pivot 110 in the direction of an arrow K. Meanwhile a tension spring 114 is connected at one end to a stationary member, not shown, and at the other end to a portion of the control arm 108 close to the control end 111*b* to normally urge the control arm 108 to pivotally move in the direction of an arrow L about the pivot 110.

In the aforesaid construction, when the photosensitive member 2 of the endless belt form is driven to move in the A direction, the tension on the side of the roller shaft 3*a* will be reduced by the action of the spring 114 to pivotally move the control arm 108 in the L direction if the solenoid 113 is not energized. Thus, according to the aforesaid principle, the photosensitive member 2 tends to deviate in the C direction. Assume that the deviation of the photosensitive member 2 in the C direction exceeds an allowable range. Then the solenoid 113 is energized to cause the control arm 108 to pivotally move in the K direction by overcoming the biasing force of the spring 114 tending to move the control arm 108 pivotally in the L direction. This restores the tension on the roller shaft 3*a* side to the original value of the tension F while reducing the tension on the roller shaft 3*b* side. At this point in time, the deviation of the photosensitive member 2 in the C direction comes to an end and a deviation thereof in the D direction begins. The correction of the deviation of the photosensitive member 2 in the C direction is accomplished.

In case the deviation of the photosensitive member 2 caused to occur by energization of the solenoid 113 exceeds an allowable range, correction of the deviation in the D direction can be accomplished by de-energizing the solenoid 113.

Figure 18:
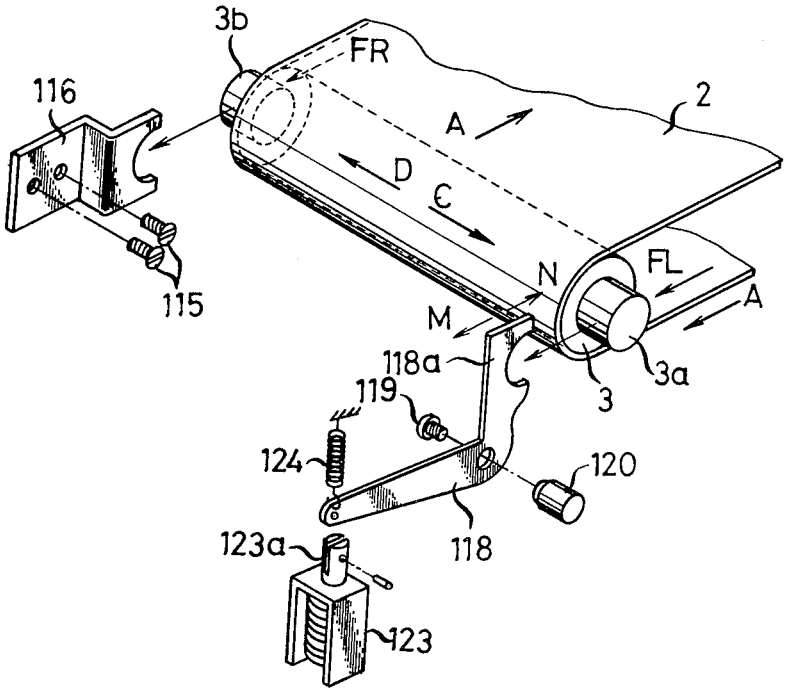
FIG. 18 is a perspective view of a second form of deviation correcting means.

FIG. 18 shows a second form of deviation correcting means based on the first concept which is distinct in principle from the first form shown in FIG. 16 in that the action of the control arm only acts on one end of the roller. More specifically, members similar to control ends 111*a* and 111*b* shown in FIG. 16 support the roller shafts and operate such that one member is stationary and the other member controls the roller when necessary.

The construction of the second form will be described in detail. The roller 3 shown in FIG. 18 imparts tension to the photosensitive member 2 of the endless belt through the action of the tension imparting means shown in FIG. 17. However, in this form of deviation correcting means, the tensions FL and FR imparted to the roller shafts on the left and right sides respectively are given beforehand with a differential FL>FR. The roller shaft 3*b* to which lower tension FR is imparted is supported by a stationary arm 116 affixed by a screw 115 to a frame, not shown, of the recording system, and the roller shaft 3*a* is supported by a control member 118*a* formed at one end of a control arm 118 of substantially L shape pivotally supported through a screw 119 extending through the junction of the two legs of the L through a pivot pin 120 connected to the frame of the recording system. A solenoid 123 has its rod 123*a* connected to an end of the control arm opposite the ends at which the control member 118*a* is formed. Energization of the solenoid 123 moves the rod 123*a* toward the body of the solenoid 123 to thereby move the control member 118*a* of the control arm 118 in the direction of an arrow M. A tension spring 124 connected to a stationary part, not shown, at one end if connected at the other end to the end of the control arm 118 adjacent the solenoid 123. Thus when the solenoid 123 is de-energized, the control member 118*a* of the control arm 118 is biased in the direction of an arrow N by the action of the spring 124.

In the aforesaid construction, when the photosensitive member 2 is driven to move in the A direction, the control member 118*a* is kept from acting on the roller shaft 3*a* if the solenoid 123 is energized, so that the tension imparted to the photosensitive member 2 is in the relation FL>FR as set beforehand. This naturally results in the member 2 deviating in the D direction. Upon de-energization of the solenoid 123, the control member 118*a* is moved in the direction of an arrow N by the action of the spring 124, to thereby reduce the tension FL on the roller shaft 3*a* side. As the tension FL becomes higher than the tension FR or FR>FL′ the photosensitive member 2 stops deviating in the D direction and begins to deviate in the C direction. Thus the deviation of the member 2 in the D direction is corrected. When the deviation of the member 2 in the C direction caused by the de-energization of the solenoid 123 exceeds a predetermined range, energization of the solenoid 123 enables the deviation of the member 2 in the C direction to be corrected.

In the deviation correcting means described hereinabove, a spring and a solenoid are used as means for causing a differential in tension to be produced. The invention is not limited to these specific means for producing a tension differential and any other suitable known drive means, such as means receiving the rotational force of a motor through an electromagnetic clutch in a necessary amount for effecting drive through a cam by the received rotational force, may be used.

The aforesaid description refers to the deviation correcting means constructed on the basis of the first concept. Deviation correcting means based on a second concept will now be described. The second concept is such that in a plurality of rollers supporting a belt, at least one of the rollers is inclined in directions substantially at right angles with respect to a plane including the shaft of the inclined roller and the shaft of the other roller, to thereby correct a deviation of the belt.

Figure 19:
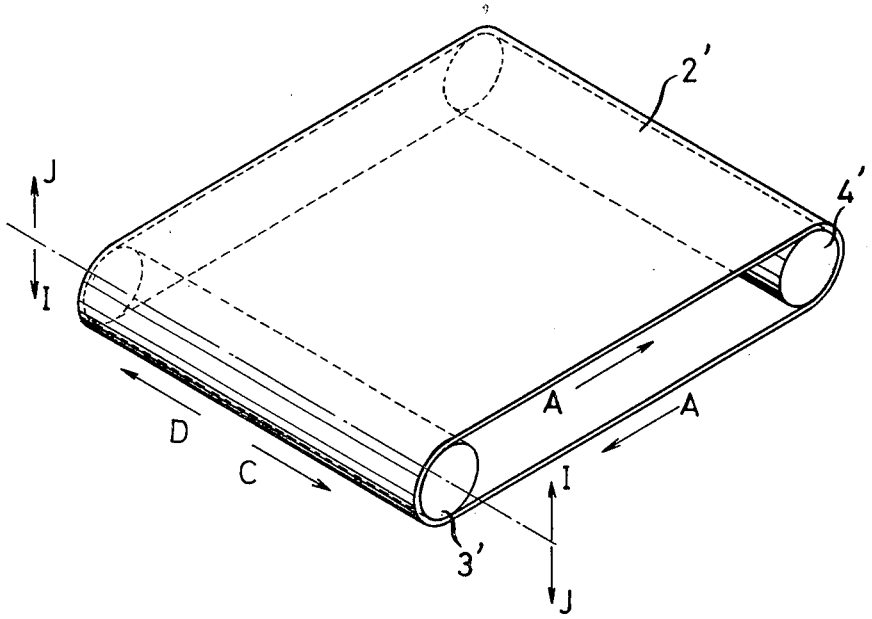
FIG. 19 is a perspective view of the endless belt recording member in explanation of a second principle of operation of the deviation correcting means.

FIG. 19 is a view in explanation of the operation of deviation correcting means based on the second concept. As shown, a belt 2′ is supported by two feed rollers 3′ and 4′ and driven for rotation in the A direction. One roller 4′ has its rotary shafts fixed and the other roller 3′ is angularly rotatable or tiltable in the directions of arrows I and J about an axis in a plane extending substantially at right angles through a plane including the axes of the rollers 3′ and 4′. When the roller 3′ is angularly rotated or tilted at the opposite ends of its axis in the I direction, the belt 2′ deviates in the D direction; when the tilting thereof is in the J direction, the belt 2′ deviates in the C direction. This phenomenon is marked when the belt 2′ is formed of material of low resilience, such as polyester terephthalate.

Some forms of deviation correcting means based on the aforesaid principle will be described. In the description presently to be set forth, parts similar to those shown in FIG. 1 are designated by like reference characters.

Figure 20:
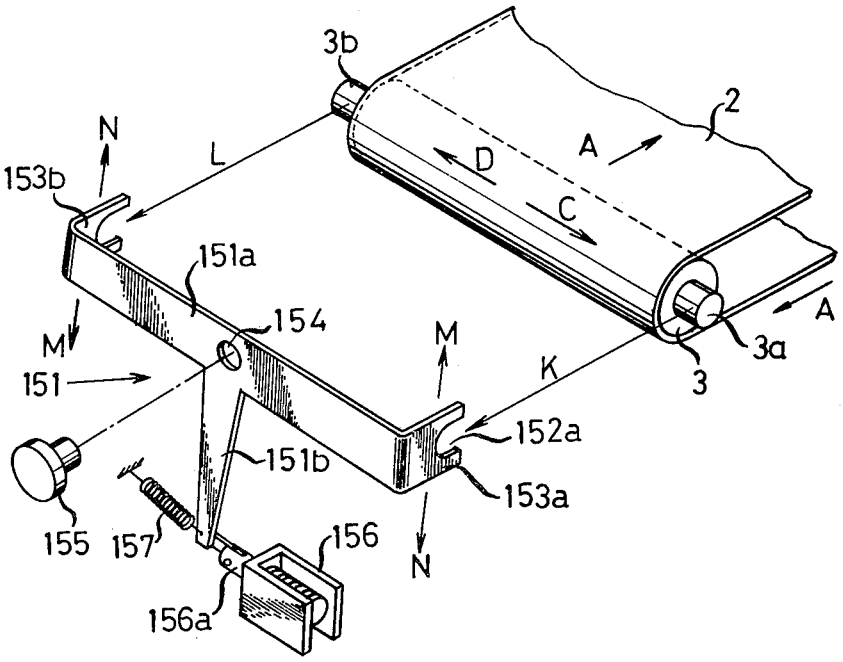
FIG. 20 is a perspective view of a third form of deviation correcting means.

FIG. 20 shows a first form of deviation correcting means based on the second concept. As shown, the photosensitive member 2 of the endless belt form is supported by two rollers or one roller 3 and the other roller 4, not shown, which is similar to that shown in FIG. 1. The roller 4 has its rotary shafts fixed, and the roller 3 has mounted in front thereof a control arm 151 substantially in the form of a letter T spaced apart from the roller 3 by the photosensitive member 2. The control arm 151 includes a horizontal arm 151*a* formed at opposite ends with control members 153*a* and 153*b* having cutouts 152*a* and 152*b* respectively. When assembled, the shafts 3*a* and 3*b* of the roller 3 are fitted in the cutouts 152*a* and 152*b* respectively in the direction of arrows K and L respectively. The control arm 151 is formed in the central portion of the horizontal arm 151*a* with an opening 154 for receiving therein a pivot pin 155 secured to a frame, not shown, of the recording system. Thus the control arm 151 can be suitably rotated or tilted about the pivot pin 155. As the control arm 151 is tilted, the roller 3 supported by the control members 153*a* and 153*b* is also tilted. The control arm 151 of the T-shape also includes a vertical arm 151b substantially at right angles to the horizontal arm 151a having a solenoid 156 located on the right side of the arm 151b and a tension spring 157 located on the left side of the arm 151b. The solenoid 156 and the tension arm 157 are connected to the lower end of the vertical arm 151b through a rod 156a and one end respectively. When energized, the solenoid 156 is operative to move the rod 156a toward its body, to thereby tilt the control arm 151 in the direction of an arrow M. When the solenoid 156 is de-energized, the control arm 151 is caused by the biasing force of the spring 17 to tilt in the direction of an arrow N.

In the aforesaid construction, when the photosensitive member 2 is driven to move in the A direction, the roller 3 is tilted in the N direction by the action of the spring 157 if the solenoid 156 is de-energized. Thus the photosensitive member 2 tends to deviate in the C direction in accordance with the aforesaid principle. Assume that the deviation of the member 2 in the C direction exceeds an allowable range, the solenoid 156 is energized to tilt the roller 3 in the M direction. This puts a stop to the deviation of the photosensitive member 2 in the C direction, and the member 2 begins to deviate in the D direction, thereby correcting the deviation of the member 2 in the C direction.

When the energization of the solenoid 156 causes a deviation of the member 2 to occur in the D direction, the deviation can be corrected by energizing the solenoid 156.

Figure 21:
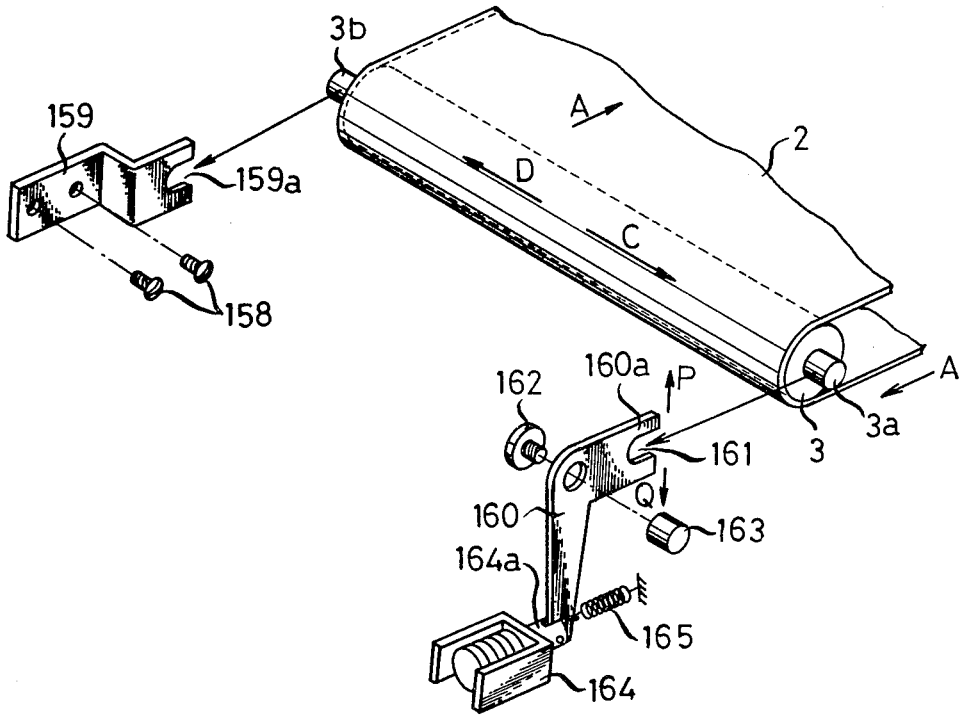
FIG. 21 is a perspective view of a fourth form of deviation correcting means.

FIG. 21 shows a second form of deviation correcting means based on the second concept which is distinct in principle from the first form shown in FIG. 20 in that only one axial end of the roller is moved in effecting deviation of the photosensitive member in endless belt form. As shown, the photosensitive member 2 of the endless belt form is supported by a roller 3 supported at one end by a shaft 3b which in turn is supported in a cutout 159a formed in a stationary arm 159 secured by a screw 158 to a frame, not shown, of the recording system. A shaft 3a supporting the roller 3 at the other end is supported in a cutout 161 formed in a control member 160a at one end of a control arm 160 substantially in the form of a letter L.

The control arm 160 is pivotally supported by a pivot pin 163 connected to the frame of the recording system through a screw 162 threadably engaging the control arm 160 at the junction of the two legs of the L. Located near the other end of the control arm 160 opposite the one end at which the control member 160a is formed are a solenoid 164 and a tension spring 165, the former being disposed outwardly at the lower end of the control member 160 and connected thereto by a rod 164a and the latter being disposed inwardly thereof and connected thereto by one end. Upon being energized, the solenoid 164 is operative to move the arm 164a toward its body, to thereby move the control member 160a in the direction of an arrow Q and tilt the roller 3 in the direction of an arrow Q about the shaft 3b as the pivot. When the solenoid 164 is de-energized, the control member 160a is moved in the direction of an arrow P by the action of the spring 165, to thereby tilt the roller 3 also in the P direction about the shaft 3b as the pivot.

In the aforesaid construction, when the photosensitive member 2 is driven to move in the A direction, the roller 3 is tilted beforehand by the action of the spring 165 if the solenoid 164 remains de-energized. Thus the photosensitive member 2 is tends to deviate in the D direction. Assume that the deviation of the member 2 exceeds an allowable range. Then the solenoid 164 is energized to tilt the roller 3 in the Q direction, to thereby put an end to the deviation of the member 2 in the D direction and the member 2 begins to deviate in the C direction. Thus the deviation of the member 2 in the D direction is corrected.

In case the deviation of the member 2 in the C direction caused by the energization of the solenoid 164 exceeds an allowble range, the deviation can be corrected by de-energizing the solenoid 164.

In the two forms of deviation correcting means, it is not advisable to move the roller in tilting movement more than is necessary. Thus, although not shown, it is preferred to use a suitable stopper mounted in a suitable position in the path of movement of the control arm 151, 160 shown in FIGS. 20 and 21, to avoid movement of the control arm more than is necessary.

In the two forms of deviation correcting means shown and described hereinabove, a combination of a solenoid and a tension spring has been used as drive means. However the invention is not limited to this specific form of drive means and any other suitable means, such as means for driving the control arm by a rotational force of a motor received in a necessary amount and transmitted through a cam or a gear, may be used.

The deviation sensing means and deviation correcting means according to the invention have been shown and described hereinabove. In actual practice, the two means are advantageously used in a combination. One mode of combining the two means into a single device will be described by referring to FIG. 22.

Figure 22:
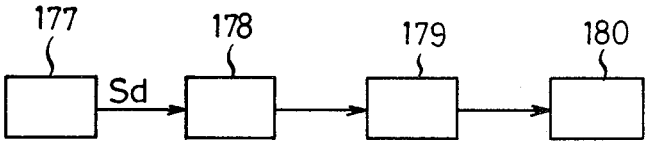
FIG. 22 is a block diagram of the control circuit for actuaing the deviation correcting means upon receipt of a signal from the deviation sensing means.

FIG. 22 is a block diagram of a device for driving the deviation correcting means by a signal produced by the deviation sensing means. As shown, deviation sensing means 177 produces a belt deviation signal Sd which is supplied to a judging circuit 178 where the direction and the timing for effecting correction are judged. The information produced by the circuit 178 is supplied to a control signal generating circuit 179 which generates, based on the aforesaid information on the direction and timing for effecting correction, a control signal for actuating or deactuating the drive means of deviation correcting means 180, such as a solenoid. The control signal generated by the circuit 179 is supplied to the deviation correcting means 180.

In the foregoing description, the invention has been described as being incorporated in an electrophotographic recording system. It is to be understood that the invention can also be incorporated in any recording system, such as an electrostatic recording system or magnetic recording system, so long as recording is carried out by using a recording member of the endless belt form while such recording member is driven for movement by a plurality of rollers.

The invention offers the advantage that no force is exerted on end portions of the endless belt type recording member to arrest the movement of the recording member, so that the recording member undergoes no deformation.

According to the invention, a deviation of the recording member of the belt form is sensed by deviation sensing means and corrected by the deviation correcting means provided to one of the rollers. No precision finishes are required for forming the recording member in the belt form and the roller associated with the deviation correcting means.

The deviation sensing means and deviation correcting means are both of simple construction, thereby avoiding an increase in the side and cost of the recording system and complication of its construction.

what is claimed is:

1. A recording system comprising a recording member in the form of an endless belt supported and driven for movement by a plurality of rollers for recording information on said recording member, comprising a device for correcting deviation of the endless belt recording member comprising:

deviation sensing means for sensing movement of said endless belt recording member in a direction at right angles to the direction of movement of the recording member and generating a signal; said deviation sensing means comprising at least one reflection type light sensor arranged in the vicinity of and juxtaposed against at least one side peripheral portion of said endles belt recording member, and a sensed pattern movable into a sensing zone of said reflection type light sensor when said recording member moves in a direction at right angles to the direction of its movement, said sensed pattern having a light reflection factor distinct from the light reflection factor of said recording member;

deviation correcting means for correcting the deviation of said recording member; and a control circuit receiving said signal generated by said deviation sensing means and actuating said deviation correcting means based on said signal.

2. A recording system as claimed in claim 1, wherein said deviation correcting means is installed in association with at least one of said plurality of rollers and operative to correct a deviation of the recording member by tilting the roller in a direction substantially at right angles to a plane including the axis of said roller and the axis of the other roller.

3. A recording system as claimed in claim 1 wherein said deviation correcting means is installed in association with at least one of said plurality of rollers and operative to correct a deviation of said recording member by causing a variation to occur in the tension imparted to said recording member by said roller between opposite ends of said roller.

4. A recording system comprising a recording member in the form of an endless belt supported and driven for movement by a plurality of rollers to carry out recording of information on said recording member, comprising a device for correcting deviation in lateral position of the endless belt recording member, comprising:

means including at least one reflection-type light sensor arranged in the vicinity of at least one side peripheral portion of said endless belt recording member for sensing any change in the light reflected to said sensor;

means including a pattern adapted to be sensed by said reflection-type sensor and movable into a sensing zone of said reflection-type light sensor when said recording member moves in a direction at right angles to the direction of normal movement, said sensed pattern having a light reflection factor distinct from the light reflection factor of said recording member;

respective supporting members each detachably supporting a respective axial shaft extending from a respective end of one of the rollers of said plurality of rollers;

means including a spring for urging at least one of said supporting members in a certain direction for tensing said endless recording member said spring being arranged in a position out of the path of movement of said endless recording member;

means including a solenoid connected to said support member by said spring for shifting it in a direction opposite to the direction of the urging of said spring, said solenoid being arranged in a position out of the path of movement of said endless recording member;

a control circuit receiving the signal generated by said reflection type light sensor and actuating said solenoid based on said signal.

5. In a recording system including a recording member in the form of an endless belt supported by a plurality of rollers and adapted to move along a predetermined endless path through the recording system, an apparatus for correcting lateral deviation of said endless belt from its path of movement, said apparatus including:

means including at least one sensor position adjacent the lateral edge portion of said path of movement for developing a signal responsive to the amount of reflected light received thereby;

means including a pattern adapted to reflect an amount of light different than that reflected by said endless belt for reflecting light to said sensor during lateral deviation of said endless belt from said path;

support means detachably connected to the axial end portions of one of said rollers for urging at least one end portion of said roller outwardly of the path of movement of said endless belt for applying tension to said belt; and correction means responsive to said signal and means including a solenoid for shifting the at least one end portion of said roller inwardly to correct deviation of said belt.

6. An apparatus according to claim 5, said pattern being formed along each side portion of said endless belt, and said sensor including two sensors each positioned inwardly of a respective pattern to sense movement of the adjacent side portion inwardly of said path.

7. An apparatus according to claim 5, said pattern being formed along one side portion of said endless belt, and said sensor including a first sensor position over the path of movement of said pattern and a second sensor positioned inwardly of said first sensor.

8. An apparatus according to claim 5, including a support plate guiding a peripheral side portion of said endless belt in its path of movement, said pattern being formed in a portion of said support plate normally covered by said endless belt during its movement without deviation in said path, but uncovered upon deviation from said path.

9. An apparatus according to claim 5, said support means including a support member having side portions having slots opening outwardly and each adapted to receive a respective end portion of an axial shaft of said roller, and springs held in said slots and urging said end portions outwardly thereof.

10. An apparatus according to claim 9, the spring force of one of said springs being greater than that of the other to urge one of said end portions outwardly more strongly than the other, said other end portion being secured in fixed position and said correction means including means responsive to said solenoid for urging said one end inwardly to correct deviation of said endless belt.

11. An apparatus according to claim 5, said path of movement including running portions extending generally parallel to said path of movement, said correction means including means for pivoting said roller in a plane generally parallel to said running portions.

12. An apparatus according to claim 5, said path of movement including running portions extending generally parallel to said path of movement, said correction means including means for pivoting said roller in a plane generally perpendicular to said running portions.

* * * * *